US005821807A

United States Patent [19]

Brooks

[11] Patent Number: 5,821,807

[45] Date of Patent: Oct. 13, 1998

[54] LOW-POWER DIFFERENTIAL REFERENCE VOLTAGE GENERATOR

[75] Inventor: Todd L. Brooks, Boston, Mass.

[73] Assignee: Analog Devices, Inc., Norwood, Mass.

[21] Appl. No.: 654,306

[22] Filed: May 28, 1996

[51] Int. Cl.[6] ..... G05F 1/10

[52] U.S. Cl. ..... 327/540; 327/539; 327/545

[58] Field of Search ..... 327/538, 540, 327/545, 539; 323/316, 313

[56] References Cited

U.S. PATENT DOCUMENTS

| | | | |
|---|---|---|---|
| 4,317,054 | 2/1982 | Caruso et al. | 327/539 |
| 4,533,876 | 8/1985 | Haque et al. | 330/253 |
| 4,857,823 | 8/1989 | Bitting | 323/314 |
| 4,906,863 | 3/1990 | Van Tran | 327/539 |
| 5,087,830 | 2/1992 | Cave et al. . | |
| 5,132,556 | 7/1992 | Cheng | 327/539 |
| 5,229,710 | 7/1993 | Kraus | 327/540 |
| 5,455,539 | 10/1995 | Mazoyer et al. | 330/258 |
| 5,541,551 | 7/1996 | Brehner et al. | 327/539 |
| 5,619,156 | 4/1997 | Jandu | 327/539 |

FOREIGN PATENT DOCUMENTS 0 350 857 A1 1/1990 European Pat. Off. .

42 24 584 A1 1/1994 Germany .

OTHER PUBLICATIONS

Todd L. Brooks and Alan L. Westwick, "A Low–Power Diferential CMOS Band Gap Reference," *1994 IEEE International Solid State Circuits Conference*, pp. 248, 249.

Germano Nicollini and Daniel Senderowicz in, "A CMOS Band Gap Reference for Differential Signal Processing," *IEEE Journal of Solid State Circuits*, vol. 26, No. 1, Jan. 1991, pp. 41–43.

*Primary Examiner*—Terry Cunningham

*Attorney, Agent, or Firm*—Wolf, Greenfield & Sacks, P.C.

[57] ABSTRACT

A differential voltage reference circuit implemented in CMOS provides a continuous differential voltage having good substrate and supply noise-rejection and low power consumption. The differential voltage reference is operable under a low voltage power supply in the range of 1–3 volts and does not require a large silicon die area. The differential voltage reference includes two parasitic bipolar transistors and a single differential summing amplifier. PTAT and CTAT differential signals are summed at the amplifier summing junctions to provide a temperature-independent differential reference voltage. The differential amplifier maintains a common-mode level of the output at a constant level with respect to a bias voltage at the bases of the two bipolar transistors.

28 Claims, 3 Drawing Sheets

LOW-POWER DIFFERENTIAL REFERENCE VOLTAGE GENERATOR

BACKGROUND OF THE INVENTION

1. Field of the Invention

The present invention relates to a MOS differential reference voltage for use with differential data converters and with differential analog signal processing circuits.

2. Discussion of the Related Art

A reference voltage with good temperature stability is often required in analog signal processing circuits. This reference is especially important in circuitry using either an analog-to-digital converter (ADC) or a digital-to-analog converter (DAC). The choice of a reference voltage is important since the performance of these mixed signal systems is affected by inaccuracies and power supply noise coupling errors in these voltage references. In addition, the reference voltage circuits is can contribute a large fraction of the analog power consumption for the mixed-signal device.

Conventionally, a "band-gap" reference circuit is used to establish the reference voltage. Operation of a band-gap voltage reference is well-known and is based on the addition of two voltages, one with a temperature coefficient which is proportional (positive) to absolute temperature (PTAT) and the other with a temperature coefficient which is complementary (negative) to absolute temperature (CTAT). The combination of the two voltages results in a voltage based on the extrapolated energy band-gap voltage of silicon in a bipolar device. This voltage has substantially a zero temperature coefficient.

When designing a reference for an analog processing circuit, many design considerations must be taken into account. These considerations include, but are not limited to, the complexity of the circuit which therefore affects the cost and the amount of area it will take up in the device. A designer has to consider how much power will be required by the device. In addition, whether the reference is needed on all clock phases will affect the design choices. Further, consideration has to be made as to functional characteristics including operability under low power supply conditions and substrate and supply-coupled noise rejection.

In implementing a system for mixed-signal processing, i.e., those circuits that mix analog and digital signals, it is important to have a low-noise environment. Noise from the digital section of a system will typically couple into the analog section of the system and degrade the signal-to-noise ratio of the analog circuitry. One commonly used technique to reduce the amplitude of high frequency coupled noise sources, thereby improving signal-to-noise ratio, is to filter that noise with a low-pass filter in the reference. For example, an external capacitor is commonly used to filter high frequency noise components of the reference voltage. However, filtering typically does not completely remove the unwanted effects of the high-frequency noise sources in many systems. This is because any non-linear elements in the reference preceding the filtering may rectify a large amplitude high-frequency noise component. This rectification will result in a dc-component which is not filtered. This is commonly referred to as "pumping" the reference voltage. The coupled noise typically includes signal dependent components which, when rectified, result in a signal-dependent variation of the reference voltage that results in distortion of an analog-to-digital or digital-to-analog converted signal.

Germano Nicollini and Daniel Senderowicz in, "A CMOS Band Gap Reference for Differential Signal Processing," *IEEE Journal of Solid-State Circuits*, Vol. 26, No. 1, January 1991 (hereafter "Nicollini, et al."), discuss a differential band-gap reference using a switched-capacitor implementation. While the differential band-gap reference described by Nicollini et al. is a common method to provide such a differential reference, it is not a continuous-time reference and this introduces certain undesirable effects. Switched-capacitor implementations typically involve an offset storage phase of operation followed by an amplification phase of operation. The differential reference, however, is only typically available during the amplification phase. This will not be sufficient in high-sampling rate applications, since it is typically necessary to have a differential reference which is available during both phases. Further, a CMOS switched-capacitor implementation depends heavily on the settling characteristics of parasitic PNP transistors in the CMOS process. This can result in inaccuracies at high clock speeds since a switched-capacitor band-gap reference might not settle to a final value in a sufficiently short amount of time for these applications.

The AD9220 analog-to-digital converter available from Analog Devices, Inc., Norwood, Mass., includes an on-board band-gap reference that generates either a 1 volt or 2.5 volt output. While the reference within the AD9220 converter provides a continuous-time signal, in operation it takes a single-ended reference and converts it to a differential signal using a differential buffer. This requires two amplifiers and the single-ended circuitry is inherently sensitive to supply and substrate-coupled noise and "pumping" of the reference voltage. Extreme care must be taken in both the design and in the layout in order to obtain low-noise single-ended circuitry such as that in the AD9220 reference. This has the very significant disadvantages of increasing design time, expense and also increasing circuit complexity.

Todd L. Brooks and Alan L. Westwick discuss a CMOS band-gap circuit providing a 2.0 volt differential voltage reference for an over-sampled data converter in "A Low-Power Differential CMOS Band Gap Reference,"1994 *IEEE International Solid State Circuits Conference* (hereafter "Brooks et al."). The band-gap reference as discussed by Brooks et al. has good power supply noise rejection but is a complicated circuit including two amplifier stages with associated offsets and gain considerations. In addition, the reference of Brooks et al. requires 5 volts for operation and, therefore, is not operable under low power supply conditions.

Many systems do not need a high accuracy reference and often will require only a reference with low-noise. This is the case with many digital-to-analog converters and analog-to-digital converters since the inaccuracy of the reference only results in an error in the full-scale range of the converter and is, therefore, tolerable. In these same systems, however, a noisy reference will result in a low signal-to-noise ratio. Signal-to-noise ratio is often much more important than the accuracy of the full-scale-range. Many systems use gain control to adjust the full-scale range of signals in the system and, consequently, in such systems, the full-scale range of the converter is not critical.

A reference circuit which supplies a continuous-time differential reference with good power supply noise rejection, good substrate-coupled noise rejection and low power consumption is required. In addition, a simple and inexpensive differential reference which is operable under low voltage power supply conditions and which does not take up a large silicon die is also needed.

SUMMARY OF THE INVENTION

A differential reference voltage circuit according to the present invention provides a continuous differential voltage having good substrate noise-rejection and good supply noise-rejection with low power consumption. This differential voltage reference uses two bipolar transistors with mis-matched emitter sizes and a single differential summing amplifier. Two differential signals generated by the mis-matched bipolar transistors are summed using four input resistors connected to the amplifier summing junctions. A temperature-independent differential reference voltage is provided using the single differential amplifier. The differential reference exhibits good power supply noise rejection and good substrate-coupled noise rejection because the circuit is implemented differentially.

One embodiment of the present invention, aimed at overcoming the drawbacks associated with the prior art, is directed to a differential reference voltage generating circuit that includes a differential voltage gain amplifier with first and second inputs, first and second outputs and a common-mode level control for controlling a common-mode level of the first and second outputs. A common-mode level setting circuit to output a common-mode level setting voltage at a predetermined level with respect to a bias voltage is also provided. In addition, a voltage generating circuit generates a first diode voltage with respect to the bias voltage and a second diode voltage different from the first diode voltage also with respect to the bias voltage. The first diode voltage is resistively coupled to the first input of the amplifier and the second diode voltage and the bias voltage are resistively coupled to the second input of the amplifier. The amplifier receives the common-mode level setting voltage and outputs a differential reference voltage as a function of the first diode voltage, the second diode voltage and the bias voltage.

In another embodiment of the invention, the voltage generating circuit includes first and second parasitic bipolar transistors implemented in CMOS with the bases coupled to the bias voltage and the collectors coupled to a substrate.

In yet another embodiment of the present invention, a differential reference voltage generating circuit includes a differential voltage gain amplifier with common-mode level control, a first bipolar transistor and a second bipolar transistor. The amplifier outputs the differential reference voltage as a function of a first voltage on a first terminal of the first transistor and a second voltage on a terminal of the second transistor and maintains a common-mode level at a predetermined level with respect to a bias level.

In still another embodiment of the present invention, a first current source is coupled to the emitter of the first bipolar transistor, the first current source providing bias current to bias the first transistor. A second current source is coupled to the emitter of the second transistor, the second current source providing bias current to bias the second transistor. The first diode voltage is a function of the bias current in the first transistor and the second diode voltage is a function of the second current in the second transistor.

A method for generating a differential reference voltage includes the steps of providing a bias level, $V_{bias}$, to a base of a first bipolar transistor having a first emitter junction area and to a base of a second bipolar transistor having a second emitter junction area. Further, generating a first differential current in a first pair of resistors, the first differential current proportional to a base-emitter voltage, $V_{BE1}$, of the first bipolar transistor. In addition, generating a second differential current in a second pair of resistors, the second differential current proportional to a difference, $\Delta V_{BE}$, between $V_{BE1}$ and a base-emitter voltage, $V_{BE2}$, of the second bipolar transistor. Then, differentially summing the first and second differential currents in the first and second pairs of resistors and generating a differential reference voltage across a third pair of resistors that is a function of $V_{BE1}$ and $\Delta V_{BE}$, the differential voltage reference having a common-mode level.

BRIEF DESCRIPTION OF THE DRAWINGS

These and other advantages of the present invention will be readily appreciated as the same becomes better understood by reference to the accompanying drawings, in which like reference numerals designate like or corresponding parts throughout, wherein.

DETAILED DESCRIPTION

The present invention is implemented using a conventional CMOS process. The bipolar transistors, to be discussed below, are the parasitic bipolar transistors found in CMOS circuits. In the case of an n-well implementation these are pnp transistors and in the case of p-well these transistors are npn transistors. These bipolar transistors typically have a substrate 106 as a collector of the device. Consequently, there is only access to a base and an emitter of a parasitic substrate transistor in a CMOS process effectively providing only a pn diode. Therefore, the transistors available in the CMOS process do not have the flexibility of three-terminal transistor but really only the capability of operating as a two-terminal diode.

Figure 1:
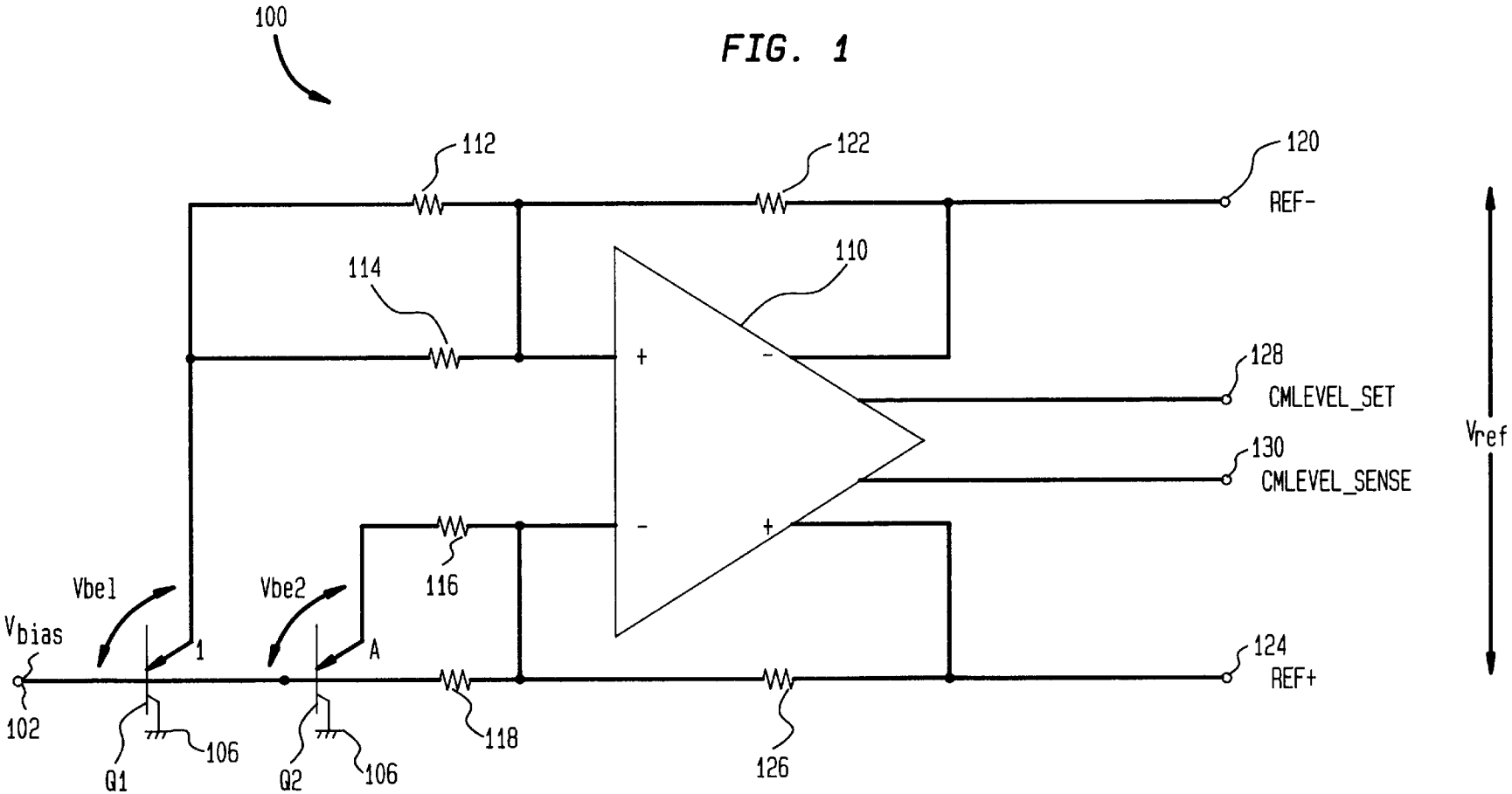
FIG. 1 is a schematic diagram of an illustrative embodiment of the differential reference voltage circuit of the present invention.

As shown in FIG. 1, a differential voltage reference circuit 100 implemented in CMOS according to the present invention includes an input terminal 102 to receive a bias level $V_{bias}$. The input terminal 102 can be, for example, a pin on an integrated circuit or an internal node within a device. It is not limited to an external connection. The word "terminal" is meant to convey the idea of a node or an element of a device. It is clear that in the case of, e.g., a monolithic bipolar transistor, the disclosed terminals are not necessarily accessible from outside the circuit. A first pnp bipolar transistor Q1 has a base terminal coupled to the input terminal 102. In addition, a collector terminal of transistor Q1 is coupled to a substrate 106. Typically the substrate is coupled to the negative supply voltage, e.g., ground. A second pnp bipolar transistor Q2 also has a base terminal coupled to the input terminal 102 and a collector terminal coupled to the substrate 106. The emitter junction areas of transistors Q1 and Q2 are typically not equal. With the emitter junction area of transistor Q1 being normalized as one unit, the emitter junction area of transistor Q2 is A times as large. In addition, in one implementation the input terminal 102 is coupled to the substrate 106.

An emitter terminal of transistor Q1 is coupled to a non-inverting input of a differential voltage gain amplifier 110 through a parallel combination of a resistor 112 and a resistor 114. (It is clear that a single resistor equal to the parallel combination of resistors 112, 114 could also be used. The separate resistors 112, 114 are shown to aid in the explanation of the circuit to follow.) An emitter terminal of transistor Q2 is coupled to an inverting input of the amplifier 110 through a resistor 116. In addition, a resistor 118 couples the input terminal 102 to the inverting input of the amplifier 110. An inverting output 120 of the amplifier 110 is coupled to the non-inverting input by a first feedback resistor 122. A non-inverting output 124 of the amplifier 110 is coupled to the inverting input by a second feedback resistor 126.

The differential reference circuit of the present invention provides a differential output voltage, $V_{REF}$, which is equal to the difference between output voltages REF+ on terminal 124 and output voltage REF− on terminal 120, where REF+ is at a higher potential than REF−. The differential voltage-gain amplifier 110 also has the capacity to control a common-mode level of the output. A common-mode level setting terminal 128 is provided in the amplifier 110 to receive a signal, CMLEVEL_SET, which sets the common mode level of the outputs. A common-mode level sensing terminal 130 is also provided to receive a signal, CMLEVEL_SENSE, which provides (from circuitry not shown) the detected common mode level at terminals 120, 124 to the amplifier 110. The amplifier 110 operates to adjust the common-mode level received on terminal 130 to be equal to the signal CMLEVEL_SET received on terminal 128.

Figure 2:
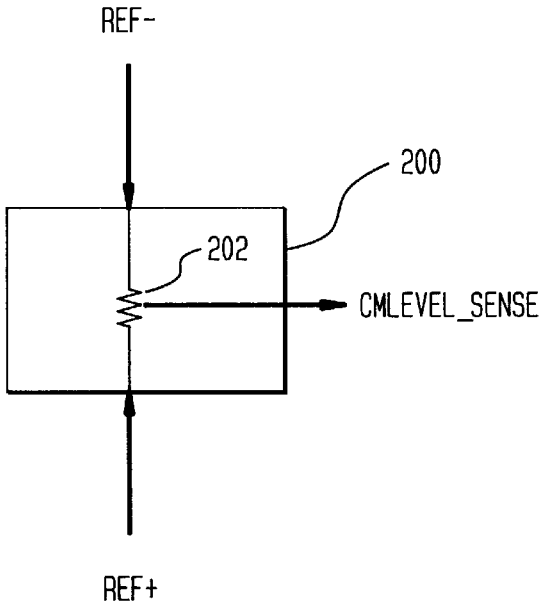
FIG. 2 is a schematic diagram of a common-mode level sensing circuit.

As shown in FIG. 2, a common-mode level sensing circuit 200 is coupled to the REF− and REF+ signals and outputs the signal CMLEVEL_SENSE to the amplifier 110 at input 130. In one embodiment, the common mode level sensing circuit 200 may be a resistor divider 202 placed across the outputs of the amplifier 110, with the signal CMLEVEL_SENSE coming from a mid-point tap on the resistor divider 202. In this embodiment, the value of the CMLEVEL_SENSE signal is equal to the average of the REF+ and REF− outputs of the amplifier 110.

Figure 3:
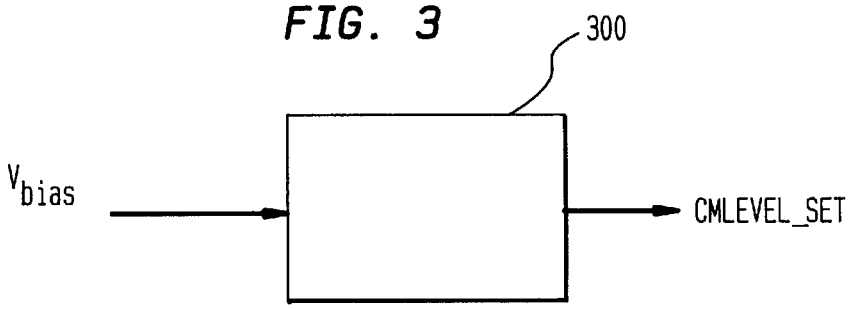
FIG. 3 is a block diagram of a common-mode level setting circuit.
Figure 4:
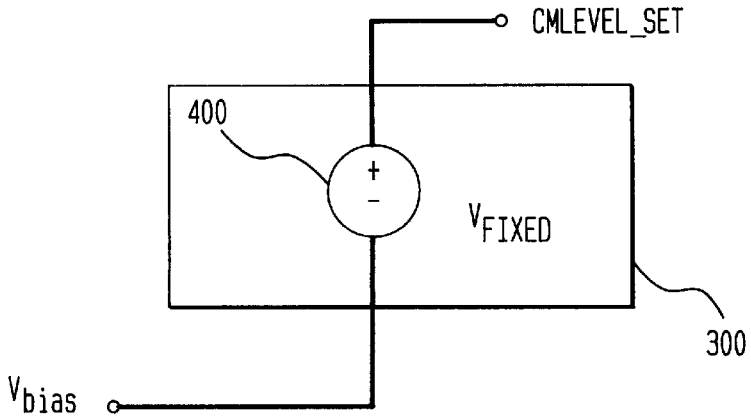
FIG. 4 is a schematic diagram of a common-mode level setting circuit.

As shown in FIG. 3, a common-mode level setting circuit 300 is coupled to the bias signal $V_{bias}$ to provide the signal, CMLEVEL_SET, at a constant level with respect to the bias signal $V_{bias}$. The common-mode level setting circuit 300 could be represented by a fixed voltage source 400 of voltage $V_{Fixed}$, as shown in FIG. 4, relative to the input bias voltage $V_{bias}$. As a result, the signal CMLEVEL_SET would be equal to $V_{bias}+V_{Fixed}$.

The common-mode level at the output of the amplifier 110 affects the bias currents in transistors Q1 and Q2. These bias currents in Q1 and Q2 depend upon several factors including the reference voltages at the output of the amplifier, the $V_{bias}$ voltage at the base of transistors Q1 and Q2, and the values of resistors 112, 114, 118, 116, and 126. Any variation of the common-mode level at the output of the amplifier 110 with respect to the voltage level $V_{bias}$ causes the voltages across the resistors to vary. This, in turn, results in a variation of current flow into the emitters of transistors Q1 and Q2, and consequently results in a variation of the differential reference voltage $V_{REF}$. It is desirable to fix the common-mode level at the output of the amplifier 110 such that it does not vary with respect to the voltage level $V_{bias}$, thus avoiding any such variations in the reference voltage $V_{REF}$.

The common-mode level, therefore, must be referenced to the voltage level, $V_{bias}$, at the bases of transistors Q1 and Q2 to maintain the supply rejection advantages of the present invention. In the following discussion the terms supply, supply-dependent, and supply-independent all refer to a supply which is defined as the difference between a positive and a negative pair of supply voltages. The approach described above for common-mode control of the amplifier 110 output differs from the conventional technique. In the conventional technique, the amplifier common-mode output level is established at a mid-level between the positive and negative supply voltages. This conventional approach results in a supply-dependent common-mode level at the output of the amplifier. If the voltage level $V_{bias}$ is established (in an unrelated manner) to a fixed supply-independent level, then this conventional approach causes the differential reference voltage $V_{REF}$ to vary with supply. Thus the supply rejection of the differential voltage reference circuit 100 will be degraded. Therefore, in order to avoid this problem and to obtain high supply rejection, it is necessary to establish a common-mode level at the output of amplifier 110 which remains fixed with respect to $V_{bias}$.

The differential reference circuit operates as a differential summing amplifier with two differential inputs. The two inputs are summed together and amplified to provide a single differential output voltage. The first of these two differential input signals is a base-emitter voltage, Vbe1, of transistor Q1. The base-emitter voltage, Vbe1, is amplified using resistors 118, 112, 122 and 126 in combination with differential amplifier 110.

The second of the two differential input signals is the difference between the base-emitter voltage, Vbe1, of transistor Q1 and a base-emitter voltage, Vbe2, of transistor Q2. This voltage difference is referred to as ΔVbe, where ΔVbe=Vbe2−Vbe1. The voltage ΔVbe is amplified using resistors 114, 116, 122 and 126 in combination with the differential amplifier 110.

The common connection of resistors 112 and 118 with respective resistors 114 and 116 at the input terminals results in the summation of the differential current in resistors 112 and 118 with the differential current in resistors 114 and 116. This results in the summation of the two differential input signals Vbe1 and ΔVbe. Effectively, these PTAT and CTAT currents are summed and dropped across resistors 122, 126 to generate a temperature independent differential reference voltage.

For the following description, the annotation $R_x$ is meant to represent the value of resistor x so that, for example, $R_{126}$ is the value of resistor 126. In the present invention, the ratio of the value $R_{122}$ to the value $R_{112}$ is nominally the same as the ratio of $R_{126}$ to $R_{118}$. That is, $K1=R_{122}/R_{112}=R_{126}/R_{118}$, where K1 is the amplification factor for the first input signal, Vbe1 . Similarly, the ratio of $R_{122}$ to $R_{114}$ is nominally the same as the ratio of $R_{126}$ to $R_{116}$. That is, $K2=R_{122}/R_{114}=R_{126}/R_{116}$, where K2 is the amplification factor of the second input signal, ΔVbe. The output reference voltage is determined by the expression, $V_{REF}$=K1*Vbe1+K2*ΔVbe.

The two amplification factors, K1 and K2, allow complete flexibility to scale the two components of the reference voltage. This is necessary both to adjust the temperature coefficient of the reference and to adjust the nominal output voltage of the reference. The first component, Vbe1, has a negative (CTAT) temperature coefficient and the second component, ΔVbe, has a positive (PTAT) temperature coefficient. These may be adjusted with respect to one another by altering the ratio of K1 to K2. Increasing K2 with respect to K1 causes the reference voltage, $V_{REF}$, to have a more positive temperature dependence. In order to obtain a reference voltage with minimal temperature variation, the value of K2 must be increased to the point where the positive temperature coefficient of the K2*ΔVbe term matches the negative temperature coefficient of the K1*Vbe1 term.

The amplitude of the second component, ΔVbe, is determined by the ratio of current densities, $I_2/I_1$*A, in transistors Q1 and Q2 where $I_2$ and $I_1$ are the collector currents in transistors Q2 and Q1, respectively, and A is the ratio of the emitter area of transistor Q1 to Q2. That is, $\Delta VBE = Vbe2 - Vbe1 = VT*1n(I_2/I_1*A)$, where VT is the thermal voltage of a pn junction and is proportional to absolute temperature. The positive temperature coefficient component of the reference voltage, K2*ΔVbe, may be scaled either through adjusting K2 or through adjusting the relative currents and sizes of transistors Q1 and Q2 in order to change the value of ΔVbe. The first component, K1*Vbe1, may be adjusted through changes to the value K1. The value of Vbe1, however, is primarily dependent upon the manufacturing process.

The nominal output voltage of the reference may be adjusted by manipulating the magnitudes of K1 and K2 together. By increasing or decreasing K1 and K2 simultaneously, the reference voltage may be increased or decreased.

The present invention avoids the complexity of generating a band-gap voltage reference using one stage of circuitry and scaling it to a desired voltage using a second stage of circuitry. The circuit, as shown in FIG. 1, is implemented in CMOS and has few supply and substrate noise coupling paths to its output. The present invention provides excellent supply-noise and substrate-noise rejection since the circuit is highly differential.

The differential reference of the present invention, as shown in FIG. 1, is operable at supply voltages of less than 3 V. For example, with a $V_{REF}$ of 0.5 V and appropriate choices of resistor values, transistor sizes, common-mode level of the output and the bias level, the reference may operate in the range of 1.8–2.0 V. Assuming $V_{bias}$ connected to ground, i.e., $V_{bias}$ connected to the negative power supply, one can obtain a Vbe1 of approximately 0.9 V (at −40° C., a worst-case scenario). In order to obtain bias current in transistor Q1, it is necessary to have REF− at a higher potential than the emitter of transistor Q1. Assuming 200–300 mV of drop between REF− and the emitter of transistor Q1, places REF− at 1.1–1.2 V. Assuming $V_{REF}$ is 0.5 V, then REF+ is 1.6–1.7 V Further assuming that the amplifier 110 requires its positive supply voltage to be at least 200–300 mV above its output terminals, results in a minimum value of 1.8–2.0 V for an operable voltage supply range.

Figure 5:
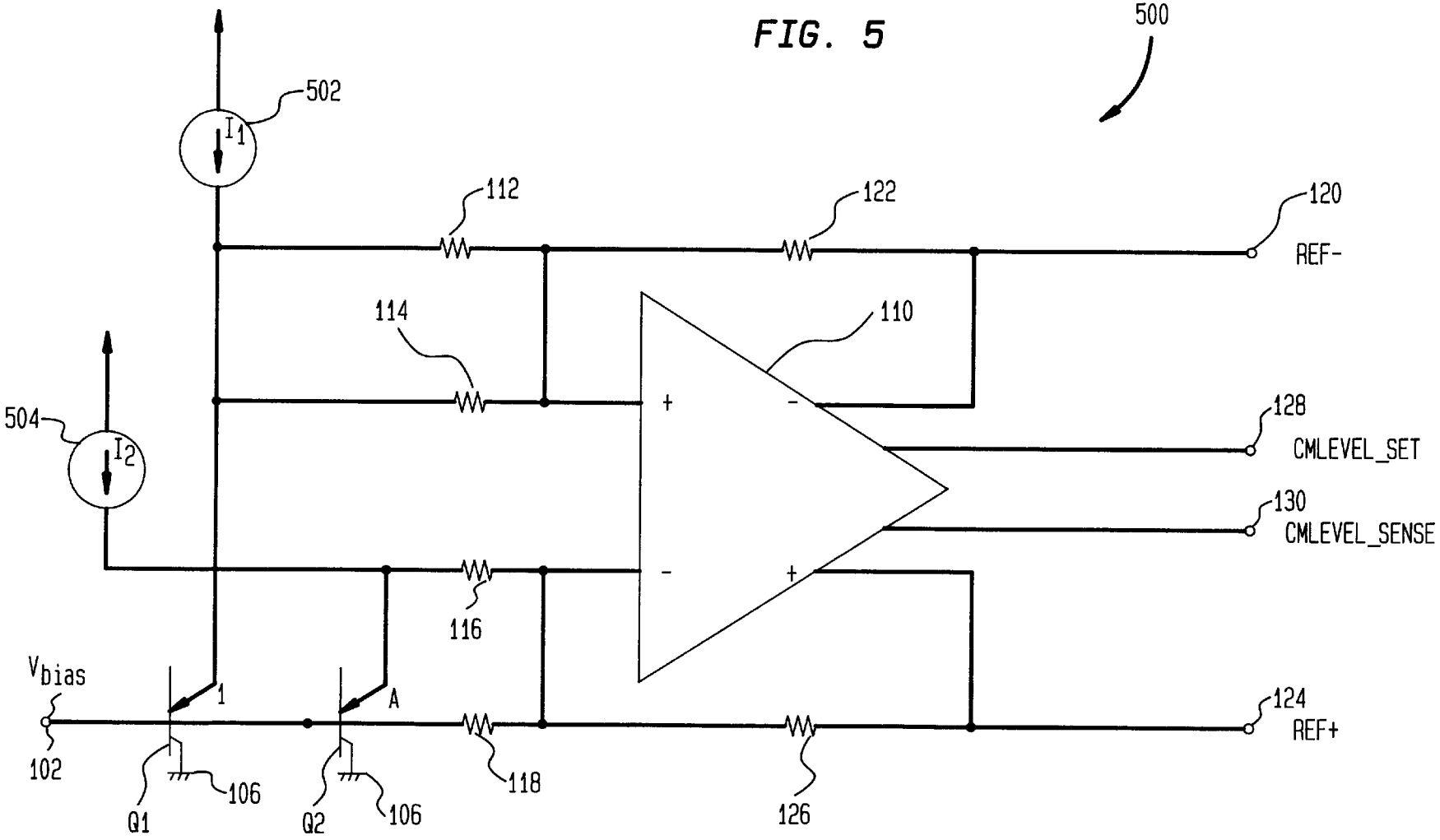
FIG. 5 is a schematic diagram of another illustrative embodiment of the present invention for use in low power operations.

In another embodiment of the present invention, operation under even lower power supply conditions than the embodiment shown in FIG. 1 is provided. As seen in FIG. 5, the low-power embodiment of the reference generator is similar to that shown in FIG. 1. In addition to the FIG. 1 circuitry, a first current source 502 is connected to the emitter of transistor Q1 and a second current source 504 is connected to the emitter of transistor Q2.

In operation under low power conditions, current source 502 maintains a bias current in transistor Q1 even when current flows from the emitter terminal of transistor Q1 into resistors 112, 114. Current source 504 maintains a bias in transistor Q2 even when current flows from the emitter terminal of transistor Q2 into resistor 116. The values of the currents going into the emitters of transistors Q1, Q2 are chosen so that the base-emitter voltages Vbe1 and Vbe2 are those that will obtain the desired differential output voltage $V_{REF}$ with a zero temperature coefficient. It should be noted that the current sources 502, 504 could be resistors connected to a supply voltage or any bias potential.

The differential reference of the present invention, as shown in FIG. 5, is operable at supply voltages of less than 2 V. For example, with a $V_{REF}$ of 0.5 V and appropriate choices of resistor values, transistor sizes, common-mode level of the output of the amplifier and the bias level $V_{bias}$, the reference may operate in the range of 1–1.2 V. Assuming that $V_{bias}$ is connected to the substrate 106, which is connected to the negative power supply, in this case ground, one can obtain emitter voltages on transistors Q1 and Q2 of approximately 0.9 V (at −40° C., a worst-case scenario). Assuming a 200–300 mV drop is required across current sources 502, 504 this results in a minimum supply voltage of 1.1–1.2 V.

In the embodiment as shown in FIG. 5, amplifier 110 may not limit the minimum supply voltage. In other words, the output voltages REF+, REF− do not have to be at voltages greater than the emitter voltages of transistors Q1, Q2. For example, assuming a $V_{REF}$ of 0.5 V, as above, a supply voltage of 1.2 V, and a common-mode level at the outputs of the amplifier of 0.6 V, then REF+ and REF− will be at 0.85 V and 0.35 V, respectively. This leaves approximately 0.35 V between REF+ and the positive supply (1.2 V) and 0.35 V between REF− and the negative supply (0 V, i.e., ground).

It should be noted that the common-mode sensing circuit 200, as shown in FIG. 2, and the common-mode level setting circuit 300, as shown in FIG. 3, can be incorporated into the amplifier 110. In addition, the amplifier 110 can be any suitable amplifier including, but not limited to, that described in pending application Ser. No. 08/639,208 entitled "Reference Buffer with Multiple Gain Stages for Large Effective Transconductance," filed Apr. 26, 1996, assigned to the same assignee as the present application and herein incorporated by reference in its entirety.

It should be understood that while the differential voltage reference of the present invention was shown and described as using pnp transistors, they were shown as exemplary only and could be interchanged with npn transistors to suit a particular application. In addition, where the input and output terminals of amplifier 110 were described as being inverting or non-inverting, these could be switched.

Having thus described illustrative embodiments of the invention, various alterations, modifications and improvements will readily occur to those skilled in the art. Such alterations, modifications and improvements are intended to be within the spirit and scope of the invention. Accordingly, the foregoing description is by way of example only and is not intended as limiting. The invention is limited only as defined in the following claims and the equivalents thereto.

What is claimed is:

1. A differential reference voltage generating circuit, comprising:

a differential voltage gain amplifier with first and second inputs and first and second outputs and a common-mode level control for controlling a common-mode level of the first and second outputs;

a common-mode level setting circuit to output a common-mode level setting voltage at a predetermined level; and a voltage generating circuit to generate a first diode voltage with respect to a bias voltage and a second diode voltage different from the first diode voltage also with respect to the bias voltage, the first diode voltage resistively coupled to the first input of the amplifier, and each of the second diode voltage and the bias voltage is resistively coupled to the second input of the amplifier through a respective path;

whereby the amplifier receives the common-mode level setting voltage and outputs a differential reference voltage as a function of the first diode voltage, the second diode voltage and the bias voltage.

2. The circuit as recited in claim 1, wherein the voltage generating circuit comprises:

a first parasitic bipolar transistor Q1 implemented in CMOS having a base, a collector, an emitter, and a first emitter junction area, the base coupled to the bias voltage and the collector coupled to a substrate; and a second parasitic bipolar transistor Q2 implemented in CMOS having a base, a collector, an emitter, and a second emitter junction area, the base of the second transistor coupled to the base of the first transistor.

3. The circuit as recited in claim 2 wherein the first emitter junction area is smaller than the second emitter junction area.

4. The circuit as recited in claim 2, wherein the voltage generating circuit further comprises:

a first current source coupled to the emitter of the first transistor, the first current source providing a first bias current to bias the first transistor; and a second current source coupled to the emitter of the second transistor, the second current source providing a second bias current to bias the second transistor;

whereby the first diode voltage is a function of the first bias current in the first transistor and the second diode voltage is a function of the second bias current in the second transistor.

5. The circuit as recited in claim 2 wherein the bases and collectors of transistors Q1 and Q2 are coupled to one another.

6. A differential reference voltage generating circuit, comprising:

an input terminal to receive a bias level $V_{bias}$;

a differential voltage gain amplifier with common-mode level control having an inverting input, a non-inverting input, a non-inverting output, and an inverting output, the inverting input resistively coupled to the input terminal through a first path, the inverting output resistively coupled to the non-inverting input and the non-inverting output resistively coupled to the inverting input;

a first bipolar transistor Q1 having a base, a first terminal, a second terminal, and a first junction between the base and the first terminal of a first area, the base coupled to the input terminal, the first terminal resistively coupled to the non-inverting input of the amplifier and the second terminal coupled to a substrate; and a second bipolar transistor Q2 having a base, a third terminal, a fourth terminal, and a second junction between the base and the third terminal of a second area, the third terminal resistively coupled to the inverting input of the amplifier through a second path, the fourth terminal coupled to the substrate and the base of the second transistor coupled to the base of the first transistor;

whereby the amplifier outputs the differential reference voltage as a function of a first voltage on the first terminal of the first transistor and a second voltage on the third terminal of the second transistor and the bias level $V_{bias}$ and maintains a common-mode level at a predetermined level with respect to the bias level $V_{bias}$ as determined by a common-mode set signal substantially always at a predetermined level with respect to the bias level $V_{bias}$ and provided at the common-mode level set input.

7. The circuit as recited in claim 6, wherein the differential voltage gain amplifier comprises:

a common-mode level sensing circuit, coupled to the inverting and non-inverting outputs of the amplifier and the common-mode sense terminal thereof, to detect a common-mode level; and a common-mode level setting circuit coupled to the bias level $V_{bias}$ to provide the common-mode set signal to the amplifier.

8. The circuit as recited in claim 6, wherein the first area of the first junction is smaller than the second area of the second junction.

9. The circuit as recited in claim 6, further comprising:

a first current source coupled to the emitter of the first transistor, the first current source providing a first bias current to bias the first transistor; and a second current source coupled to the emitter of the second transistor, the second current source providing a second bias current to bias the second transistor;

whereby the first diode voltage is a function of the first bias current in the first transistor and the second diode voltage is a function of the second bias current in the second transistor.

10. The circuit as recited in claim 9, wherein the first area of the first junction is smaller than the second area of the second junction.

11. The circuit as recited in claim 6, wherein the input terminal is coupled to a power supply level.

12. A differential reference voltage generating circuit, comprising:

an input terminal to receive a bias level $V_{bias}$;

a differential voltage gain amplifier with common-mode control having an inverting input, a non-inverting input, a non-inverting output, an inverting output, a common-mode sense input and a common-mode level set input, the inverting input resistively coupled to the input terminal through a first path, the inverting output resistively coupled to the non-inverting input and the non-inverting output resistively coupled to the inverting input;

a first bipolar transistor Q1 having a base, a first terminal, a second terminal, and a first junction between the base and the first terminal, the first junction having a first area, the base coupled to the input terminal, the first terminal resistively coupled to the non-inverting input of the amplifier and the second terminal coupled to a substrate;

a second bipolar transistor Q2 having a base, a third terminal, a fourth terminal, and a second junction between the base and the third terminal, the second junction having a second area, the third terminal resistively coupled to the inverting input of the amplifier through a second path, the fourth terminal coupled to the substrate and the base of the second transistor coupled to the base of the first transistor;

a common-mode level sensing circuit, coupled to the inverting and non-inverting outputs of the amplifier and the common-mode sense input, the common-mode sensing circuit to sense a common-mode level of the outputs of the amplifier and to output to the common-mode sense input a signal that is a function of the common-mode level; and a common-mode level setting circuit coupled to the input terminal and the common-mode set input, the common-mode level setting circuit providing a common-mode set signal substantially always at a predetermined level with respect to the bias level $V_{bias}$;

whereby the amplifier outputs the differential voltage reference as a function of a first voltage on the first terminal of the first transistor, a second voltage on the third terminal of the second transistor and the bias level $V_{bias}$ and maintains the common-mode level at the predetermined level with respect to the bias level $V_{bias}$.

13. The circuit as recited in claim 12, wherein each of the first and second bipolar transistors is a parasitic bipolar transistor implemented in CMOS, each of the first and third terminals is an emitter and each of the second and fourth terminals is a collector.

14. The circuit as recited in claim 12, wherein the input terminal is coupled to a power supply voltage.

15. The circuit as recited in claim 12, wherein the first area of the first junction is smaller than the second area of the second junction.

16. The circuit as recited in claim 15, wherein each of the first and second bipolar transistors is a parasitic bipolar transistor implemented in CMOS, each of the first and third terminals is an emitter and each of the second and fourth is a collector terminal.

17. The circuit as recited in claim 12, further comprising:

a first current source coupled to the emitter of the first transistor, the first current source providing a first bias current to bias the first transistor; and a second current source coupled to the emitter of the second transistor, the second current source providing a second bias current to bias the second transistor;

whereby the first diode voltage is a function of the first bias current in the first transistor and the second diode voltage is a function of the second bias current in the second transistor.

18. The circuit as recited in claim 17, wherein the first area of the first junction is smaller than the second area of the second junction.

19. The circuit as recited in claim 17, wherein each of the first and second bipolar transistors is a parasitic bipolar transistor implemented in CMOS, each of the first and third terminals is an emitter and each of the second and fourth terminal terminals is a collector.

20. The circuit as recited in claim 12, further comprising:

a first resistor coupling the first terminal of the first transistor to the non-inverting input;

a second resistor coupling the third terminal of the second transistor to the inverting input;

a third resistor coupling the bias signal to the inverting input;

a first feedback resistor to couple the inverting output to the non-inverting input; and a second feedback resistor to couple the non-inverting output to the inverting input.

21. The circuit as recited in claim 20, wherein each of the first and second bipolar transistors is a parasitic bipolar transistor implemented in CMOS, each of the first and third terminals is an emitter and each of the second and fourth terminals is a collector.

22. A method for generating a differential reference voltage, comprising the steps of:

providing a bias level, $V_{bias}$, to a base of a first bipolar transistor having a first emitter junction area and to a base of a second bipolar transistor having a second emitter junction area;

generating a first differential current in a first pair of resistors, the first differential current proportional to a base-emitter voltage, $V_{BE1}$, of the first bipolar transistor;

generating a second differential current in a second pair of resistors, the second differential current proportional to a difference, $\Delta V_{BE}$, between $V_{BE1}$ and a base-emitter voltage, $V_{BE2}$, of the second bipolar transistor; and differentially summing the first and second differential currents in the first and second pairs of resistors and generating a differential reference voltage across a third pair of resistors that is a function of $V_{BE1}$ and $\Delta V_{BE}$, the differential voltage reference having a common-mode level.

23. The method as recited in claim 22, further comprising steps of:

providing a first bias current to bias the first transistor;

providing a second bias current to bias the second transistor;

whereby $V_{BE1}$ is a function of the first bias current in the first transistor and $V_{BE2}$ is a function of the second bias current in the second transistor.

24. The method as recited in claim 22, further comprising the steps of:

providing the first transistor with a first emitter junction area; and providing the second transistor with a second emitter junction area greater than the first emitter junction area.

25. The method as recited in claim 22, further comprising the step of:

setting the common-mode level to be at a predetermined level with respect to the bias level $V_{bias}$.

26. The method as recited in claim 22, wherein the step of differentially summing and amplifying comprises the steps of:

resistively coupling an emitter of the first bipolar transistor to a first differential input of a differential voltage gain amplifier;

resistively coupling an emitter of the second bipolar transistor to a second differential input of the differential voltage amplifier; and resistively coupling the bias level $V_{bias}$ to the second differential input.

27. The method as recited in claim 22, further comprising the steps of:

generating a first constant current in an emitter of the first bipolar transistor; and generating a second constant current in an emitter of the second bipolar transistor.

28. The method as recited in claim 22, further comprising the steps of:

providing a first parasitic bipolar transistor implemented in CMOS as the first bipolar transistor;

providing a second parasitic bipolar transistor implemented in CMOS as the second bipolar transistor;

coupling a collector of the first transistor and a collector of the second transistor to a substrate; and coupling the bases of the first and second transistors to one another.

* * * * *